United States Patent [19]

Miller et al.

[11] Patent Number: 4,958,663

[45] Date of Patent: Sep. 25, 1990

[54] WOVEN MULTI-LAYER ANGLE INTERLOCK FABRICS HAVING FILL WEAVER YARNS INTERWOVEN WITH RELATIVELY STRAIGHT EXTENDING WARP YARNS

[75] Inventors: Wilbur T. Miller; Dominic P. Calamito, both of Rancho Palos Verdes; Richard H. Pusch, Huntington Beach, all of Calif.

[73] Assignee: Hitco, Cleveland, Ohio

[21] Appl. No.: 232,450

[22] Filed: Aug. 15, 1988

[51] Int. Cl.[5] ..... D03D 11/00; D03D 13/00

[52] U.S. Cl. ..... 139/384 R

[58] Field of Search ..... 139/408, 411, 412, 413, 139/384 R, 409, 410, 414, 415, 419

[56] References Cited

U.S. PATENT DOCUMENTS

| | | | |
|---|---|---|---|
| 710,775 | 10/1902 | Hardwick | 139/408 |
| 870,697 | 11/1907 | Stevenson | 139/408 |
| 898,941 | 9/1908 | Vogel | 139/408 |
| 2,681,667 | 6/1954 | Slaughter | 139/384 R |
| 2,741,824 | 4/1956 | Robbins et al. | 139/408 X |
| 3,000,771 | 9/1961 | Runton | 139/408 X |
| 3,749,138 | 7/1973 | Rheaume et al. . | |
| 3,871,415 | 3/1975 | Wolfgang et al. | 139/59 |
| 4,312,913 | 1/1982 | Rheaume . | |

FOREIGN PATENT DOCUMENTS

| | | | |
|---|---|---|---|
| 27154 | 2/1907 | United Kingdom | 139/409 |

*Primary Examiner*—Andrew M. Falik

*Attorney, Agent, or Firm*—Scherlacher, Mok & Roth

[57] ABSTRACT

A multi-layer angle interlock fabric is woven from warp yarns that extend in straight fashion in a common direction along the length of the fabric and fill yarns which repeatedly extend through the thickness of the fabric along angled paths between opposite broad surfaces of the fabric and interweave within the relatively straight warp yarns. The fabric can be woven using a conventional fly shuttle loom with a programmable Jacquard machine which controls the loom's harness lines to selectively raise and lower the fill yarns extending through a weaving area of the loom as the loom shuttle reciprocates through the weaving area to repeatedly extend a fill yarn across the width of the fabric being formed. Stuffer yarns can be provided by periodically extending the fill yarn across the fabric width betweem adjacent sheets of the warp yarns during weaving. Weaving the fabric in this fashion allows a slot to be formed across part of the fabric width within the fabric thickness by restricting the adjacent portions of the fill yarns to the opposite sides of the interface between an adjacent pair of fill yarn sheets where the slot is to be formed.

20 Claims, 4 Drawing Sheets

WOVEN MULTI-LAYER ANGLE INTERLOCK FABRICS HAVING FILL WEAVER YARNS INTERWOVEN WITH RELATIVELY STRAIGHT EXTENDING WARP YARNS

BACKGROUND OF THE INVENTION

1. Field of the Invention

The present invention relates to multi-layer woven fabrics, and more particularly to fabrics having a first yarn system arranged into plural yarn layers between opposite broad surfaces of the fabric and a second yarn system extending through the thickness of the fabric between the opposite broad surfaces and being interwoven with the yarn layers.

2. Description of the Prior ARt

It is known in the art of multi-layer woven materials to weave a fabric from a plurality of different yarn systems which provide the fabric with multiple interwoven layers or plies of thickness. Fabrics of this type can be woven using a circular loom such that the fabrics have an essentially circular makeup or configuration. Fabrics of that type are illustrated by U.S. Pat. No. 3,749,138 of Rheaume et al, which patent issued July 31, 1973 and is commonly assigned with the present application. The Rheaume et al patent describes the weaving of a multi-layer fabric which is comprised of angled warp yarns extending through the thickness of the fabric and interwoven with fill yarns which extend along the length of the fabric in an orientation generally parallel to one another and to the opposite broad surfaces of the fabric and perpendicular to the warp yarns. A third or stuffer yarn system may be present such that generally parallel stuffer yarns extend across the width of the fabric in orientations perpendicular to the fill yarns.

Multi-layer fabrics may also be woven in a noncircular configuration such as in other curved configurations or in a generally rectangular configuration using conventional weaving apparatus. An example of such woven configurations is provided by U.S. Pat. No. 4,312,913 of Rheaume, which patent issued Jan. 26, 1982. The Rheaume patent illustrates fabric produced by an angle weave in which lengths of fill yarn disposed in a nominally parallel configuration are interwoven with angled warp yarns. The warp yarns extend in a zig-zag configuration through the thickness of the fabric between the opposite broad surfaces thereof so as to form a succession of intersecting warp sheets. The warp sheets intersect with and form acute angles with the opposite broad surfaces of the woven fabric and with yarn layers formed by the fill yarns.

The multi-layer woven fabrics described in U.S. Pat. No. 3,749,138 of Rheaume et al and U.S. Pat. No. 4,312,913 of Rheaume are typical of woven angled fabrics in which the warp yarn system extends through the entire thickness of the fabric to provide an integral, tightly woven multi-layer fabric having generally uniform properties throughout the thickness thereof. Such structures are advantageous for many applications calling for multi-layer fabrics with good structural and other properties. However, it may be desirable for certain applications to provide alternate forms of multi-layer angle interlock fabrics and methods of making them in order to achieve other structural configurations or advantages For example, it may be advantageous to provide a multi-layer fabric in which one of the yarn systems extends in relatively straight fashion along the length of the fabric as woven to provide the fabric with substantial strength in the length direction. By way of further example it may be advantageous to provide a multi-layer woven fabric having a slot therein extending across a portion of the width of the fabric and along the length of the fabric.

SUMMARY OF THE INVENTION

The foregoing and other objects are accomplished in accordance with the invention by providing a multi-layer angle interlock fabric woven using conventional loom apparatus such as a fly shuttle loom equipped with a Jacquard machine for programming. In accordance with the invention, however, the loom is set up so that the warp yarns extend in relatively straight fashion in a common direction along the length of the fabric to be formed and are arranged into a plurality of generally planar, spaced-apart, generally parallel warp sheets disposed between the opposite broad surfaces of the fabric to be formed. During weaving, the loom shuttle repeatedly extends a fill yarn across the width of the fabric to be formed, and the shedding motion of the warp yarns causes the fill yarns to repeatedly extend through the thickness of the fabric along angled paths between the opposite broad surfaces as they interweave with the relatively straight warp yarns of the various warp sheets to form an angle interlock fabric.

By weaving the fabric so that the warp yarns are arranged into planar sheets between the opposite broad surfaces with the fill yarns repeatedly extending between the opposite broad surfaces to form the angled interlocking weave, various fabric advantages and configurations can be achieved which are not possible with more conventional weaving techniques. Thus, fabrics can be woven in which the relatively straight warp yarns provide the fabric with substantial strength in the direction of the length thereof. Lateral strength or rigidity across the width of the fabric can be provided by periodically extending the fill yarn across the fabric width between adjacent warp sheets during weaving to form fill stuffer yarns.

Also, the fabric can be woven so as to have a slot therein extending across part of the width of the fabric within the thickness of the fabric between the opposite broad surfaces thereof and extending along the entire fabric length. This is provided by weaving the fabric so that the fill yarns extend repeatedly through the entire thickness of the fabric along opposite end portions of the width of the fabric. Along an intermediate portion of the fabric width, however, the fill yarns are divided into two different groups disposed on opposite sides of the slot. A first group of the fill yarns repeatedly extends between one of the opposite broad surfaces of the fabric and an interface between an adjacent pair of the warp sheets where the slot is formed. The other group of fill yarns extends repeatedly between the opposite broad surface of the fabric and the slot forming interface. The slot is formed by the absence of a portion of a warp yarn layer along the interface between the adjacent pair of the warp yarn layers along the intermediate portion of the width of the fabric.

Woven fabrics in accordance with the invention may be of relatively thin, generally planar configuration so as to have opposite broad surfaces extending along the length and across the width of the fabric and defining the fabric thickness therebetween. The warp yarns extend in a common direction along the length of the fabric and are arranged into a plurality of layers thereof between the opposite broad surfaces of the fabric. The layers define the spaced-apart, generally parallel, generally planar warp sheets. The fill yarns extend back and forth across the width of the fabric in zig-zag fashion so as to be interwoven with at least two of the warp sheets and more typically with all of the warp sheets between the opposite broad surfaces of the fabric. The fill yarns are interwoven with the warp yarns so as to undulate over and under different warp yarns across the width of the fabric. As a result, the fill yarns are arranged into generally planar fill yarn sheets which extend through at least a portion of the fabric thickness and which form acute angles with the warp yarn sheets and with the opposite broad surfaces of the fabric. As previously noted, the fabric can be provided with fill stuffer yarns where desired. Such stuffer yarns extend across the fabric width in a common direction perpendicular to the common direction of the warp yarns with each stuffer yarn being disposed between an adjacent pair of the warp yarns sheets. As such, the stuffer yarns are arranged into stuffer sheets with each stuffer sheet being disposed between an adjacent pair of the warp sheets across the width of the fabric.

In slotted fabrics according to the invention, the fill yarns terminate at an interface between an adjacent pair of warp yarn layers along an intermediate portion of the fabric width between opposite end portions of the width. However, the fill yarns extend through the entire fabric thickness across the opposite end portions of the fabric width. As such, the fill yarns are divided into first and second groups within the intermediate portion of the width such that the two different groups of fill yarns extend through the fabric thickness on opposite sides of the interface so that the slot is formed along the interface.

In methods of weaving fabrics according to the invention, a plurality of warp yarns are arranged so as to form a plurality of generally planar warp sheets disposed in generally parallel, spaced-apart relation through the thickness of the fabric to be woven between opposite broad surfaces of the fabric to be woven. Each of the warp sheets extends along the length and across the width of the fabric to be woven. A fill yarn is repeatedly pulled in opposite directions across the width of the fabric to be formed. With each pulling of the fill yarn across the width, the warp yarns within each warp sheet are individually positioned so that they are either above or below the shuttle as the fill yarn is inserted. Typically, with each pulling of the fill yarn across the fabric width, the warp yarns within each warp sheet are controlled so that at least one of the warp yarns within the sheet is above and at least one of the warp yarns within the sheet is below the fill yarn. Fill stuffer yarns may be formed during movement of the fill yarn across the width of the fabric to be formed by controlling the warp yarn positions so that one or more of the warp sheets are above the fill yarn with the remaining warp sheets being below the fill yarn.

Conventional weaving apparatus such as a fly shuttle loom with a programmable Jacquard machine can be used to carry out methods in accordance with the invention. The warp yarns are positioned so as to extend through the weaving area of the loom with each of the warp yarns being coupled to and thereby controlled by a different harness line within the loom. The harness lines individually position the warp yarns above and below the shuttle as the shuttle repeatedly passes through the weaving area to pull a fill yarn therethrough. The loom is basically programmed to position the warp yarns so that fill weaver yarns are formed, the fill weaver yarns repeatedly extending through the thickness of the fabric between the opposite broad surfaces thereof. The loom can also be programmed to occasionally form fill stuffer yarns by causing the shuttle to pass between an adjacent pair of the warp sheets. Slotted fabrics may be formed by controlling the harness lines to position the warp yarns so that the fill yarn repeatedly extends through either one or the other of opposite portions of the thickness of the fabric on the opposite sides of the interface between an adjacent pair of the warp sheets along a portion of the fabric width.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
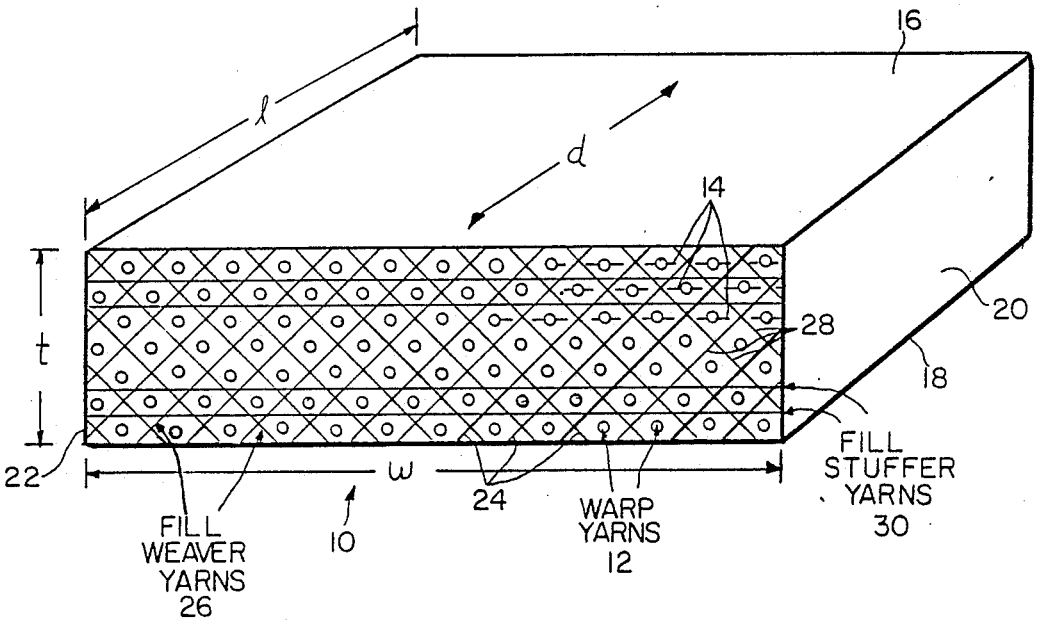
FIG. 1 is a perspective view with sectional side elevation of a woven multi-layer angle interlock fabric in accordance with the invention.

FIG. 1 depicts an example of a multi-layer woven fabric 10 in accordance with the invention. The fabric 10 includes a first yarn system in the form of a plurality of warp yarns 12. The warp yarns 12 extend in relatively straight fashion along the length "l" of the fabric 10 in a common direction "d". The warp yarns 12 are arranged into a plurality of warp layers or sheets 14. The warp sheets 14, portions of several of which are illustrated by dotted lines in FIG. 1, are of generally planar configuration and are disposed in generally parallel, spaced-apart relation between a pair of opposite broad surfaces 16 and 18 of the fabric 10.

The distance between the opposite broad surfaces 16 and 18 defines the thickness "t" of the fabric 10. The thickness "t" is in a direction which is generally perpendicular to the common direction "d" of the warp yarns 12 along the length "l" of the fabric 10.

In addition to the opposite broad surfaces 16 and 18, the fabric 10 has a pair of opposite side surfaces 20 and 22 the distance between which defines the width "w" of the fabric 10. The width "w" extends in a direction which is generally perpendicular to both the direction of the thickness "t" and the common direction "d" of the length "l".

In addition to the warp yarns 12, the fabric 10 includes fill yarns 24 which are basically comprised of fill weaver yarns 26. The fill weaver yarns 26 repeatedly extend through the thickness "t" of the fabric 10 between the opposite broad surfaces 16 and 18 across the width "w" of the fabric 10. In the example of FIG. 1, each of the fill weaver yarns 26 extends through the entire thickness "t" of the fabric 10 and does so repeatedly as it extends across the width "w" of the fabric 10. The fill weaver yarns 26 form fill yarns planes or fill sheets 28 which extend back and forth across the thickness "t" of the fabric 10 in zigzag fashion and which form acute angles with the generally planar warp sheets 14 and with the opposite broad surfaces 16 and 18.

The fill yarns 24 of the fabric 10 may also include fill stuffer yarns 30, four of which are shown in FIG. 1. Each of the fill stuffer yarns 30 extends across the width "w" of the fabric 10 in relatively straight fashion so as to be disposed between an adjacent pair of the warp sheets 14.

Figure 2:
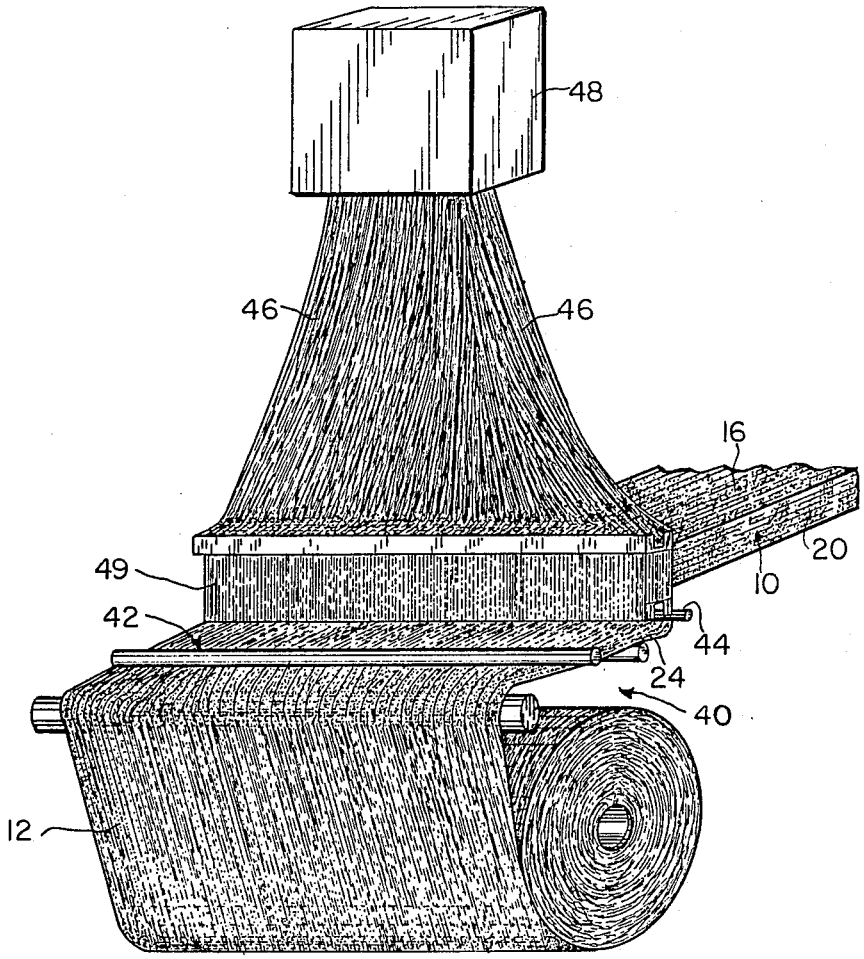
FIG. 2 is a perspective view of a fly shuttle loom with a programmable Jacquard machine illustrating the manner in which fabrics according to the invention such as the fabric of FIG. 1 may be woven.

As described hereafter in connection with FIG. 2, the fabric 10 of FIG. 1 can be woven using conventional weaving apparatus such as a fly shuttle loom with a Jacquard machine. Nonetheless, the fabric 10 differs from conventional multi-layer woven fabrics in that the warp yarns 12 of the fabric 10 extend along the length "l" of the fabric 10 in relatively straight, generally continuous fashion while the fill yarns 24 form the weavers which undulate over and under the individual warp yarns 12 and which extend between the opposite broad surfaces 16 and 18 of the fabric 10 through the thickness "t" across the width "w" of the fabric 10. Such an arrangement provides certain advantages which will become more apparent from the following discussions.

Thus, the fabric 10 is provided with substantial strength in the direction "d" of the length "l" due to the fact that the warp yarns 12 extend in relatively straight, generally continuous fashion along the length. Lateral rigidity across the width "w" of the fabric 10 can be provided where desired by the fill stuffer yarns 30 which extend in relatively straight, generally continuous fashion across the width "w" of the fabric 10. And, of course, strength in the direction of the thickness "t" is provided by the fact that the fill yarns 24 extend continuously as well as repeatedly through the entire thickness "t" of the fabric 10. As should be appreciated, the terms "length" and "width" as they are used in rlation to the fabric 10 are consistent with conventionally used nomenclature where fabric length is the diemsnion of the fabric in the warp direction and fabric width is the diemsnion of the fabric in the fill direction.

As described hereafter, fabrics of the type shown in FIG. 1 and woven in accordance with the invention may be woven in configurations not previously possible. As described in connection with FIGS. 3–5, for example, such fabrics may be woven with a slot in the thickness thereof which extends across part but not all of the width and which extends along the entire length of the fabric.

FIG. 2 shows a conventional Jacquard loom 40 which is one example of conventional weaving apparatus that may be used to weave fabrics in accordance with the invention including the fabric 10 of FIG. 1. The loom 40 shown in FIG. 2 includes a central weaving area 42 through which a shuttle 44 repeatedly passes in reciprocating fashion to dispose the fill yarn 24 therein. The loom 40 has a plurality of harness lines 46 which are individually controllable by an overhead Jacquard machine 48 in accordance with a program and which extend downwardly into the weaving area 42. Each of the harness lines 46 controls a different one of the warp yarns 12 via an attached heddle 49 having an eyelet through which the warp yarn passes. The warp yarns 12 are arranged into the various warp yarn sheets 14 as they extend through the weaving area 42. The warp sheets 14 define the relatively thin, generally planar form of the fabric 10 being woven including the opposite broad surfaces 16 and 18 and the side surfaces 20 and 22.

The warp yarns 12 are gradually advanced through the weaving area 42, and the shuttle 44 repeatedly traverses the weaving area 42, in conventional fashion. In accordance with the invention, however, the action of the harness lines 46 is programmed so that the warp yarns 12 are raised and lowered as necessary to achieve the appropriate fabric configurations such as the fabric 10 of FIG. 1. Although the fill yarn 24 is laid in straight with each pass of the shuttle 44 through the weaving area 42, the fill yarn 24 eventually assumes the zig-zag configuration shown in FIG. 1 due to raising and lowering and proper tensioning of the warp yarns 12 to provide shedding action.

In weaving the fabric 10 of FIG. 1 a different one of the harness lines 46 is coupled to each of the warp yarns 12 via an attached one of the heddles 49. With each pass of the shuttle 44 through the weaving area 42 which results in the zig-zag configuration shown in FIG. 1 across the width "w" of the fabric 10, the harness lines 46 are controlled in accordance with the predetermined program of the Jacquard machine 48 to dispose the warp yarns 12 above and below the passing shuttle 44 and the included bobbin of fill yarn 24 dispensed therefrom. At least one of the warp yarns 12 within each warp sheet 14 is positioned above the shuttle 44 and at least one of the warp yarns 12 within the same sheet 14 is positioned below the shuttle 44. Typically, a plurality of the warp yarns 12 within a given warp sheet 14 are positioned on one side of the shuttle 44 with the remaining warp yarns 12 within the warp sheet 14 being positioned on the opposite side of the shuttle 44 as the shuttle 44 carries the fill yarn 24 through the weaving area 42. The fill yarns 24 repeatedly extend through at least a portion of the thickness of the fabric comprised of two or more warp sheets, and in the example of FIG. 1 the fill yarn 24 repeatedly extends through the entire thickness "t" of the fabric 10.

The fill stuffer yarns 30 of the fabric 10 of FIG. 1 are formed using selected passes of the shuttle 44 through the weaving area 42 of the loom 40. When a fill stuffer yarn 30 is to be formed, the harness lines 46 are programmed to position all of the warp yarns 12 within each warp sheet 14 either above or below the shuttle 44 as shown in FIG. 1. This enables the shuttle 44 and the included fill yarn 24 to pass through an adjacent pair of the warp sheets 14 and thereby form one of the fill stuffer yarns 30. During formation of the fill weaver yarns 26 however, the harness lines 46 must position the warp yarns 12 of each warp sheet 14 above and below the shuttle 44 in accordance with the predetermined program so that the desired zig-zag configuration of the fill weaver yarns 26 across the entire thickness "t" of the fabric 10 is accomplished.

A conventional shuttle loom without a Jacquard machine can be used in place of the loom 40 shown in FIG. 2 to weave fabrics in accordance with the invention. However, most conventional shuttle looms without a Jacquard machine do not have the capacity to weave fabrics of the size or complexity that are typically desired. Because a separate warp harness is required for each warp yarn 12, even the relatively simple fabric 10 shown in FIG. 1 would exceed the warp harness capacity of most conventional shuttle looms. On the other hand, only a relatively small number of fill picks are required to form the fill weaver yarns 26, before the pattern repeats. For this reason, the conventional Jacquard loom with its relatively large number of harness lines 46 is better suited to the weaving of fabrics in accordance with the invention.

It will be seen that the length of multi-layer woven fabrics in accordance with the invention such as the fabric 10 is defined by the direction of the warp yarns 12. Because the warp yarns 12 are advanced through the loom 40 from front to rear during the weaving process and are of potentially unlimited length, the length of the fabric is potentially unlimited. On the other hand the width of the fabric, which in the case of the fabric 10 is defined by the distance "w" between the opposite side surfaces 20 and 22, is limited by the width and the capacity of the loom 40 used to weave the fabric. The cross-sectional configuration of the fabric between the opposite side surfaces 20 and 22 and between the opposite broad surfaces 16 and 18 can be and normally is uniform throughout the potentially unlimited length of the fabric. This is taken advantage of in accordance with the invention in the weaving of certain fabric configurations such as a fabric having a slot within a portion of the thickness thereof, which slot extends along the entire length of the fabric. Such a fabric is shown in FIG. 3.

Figure 3:
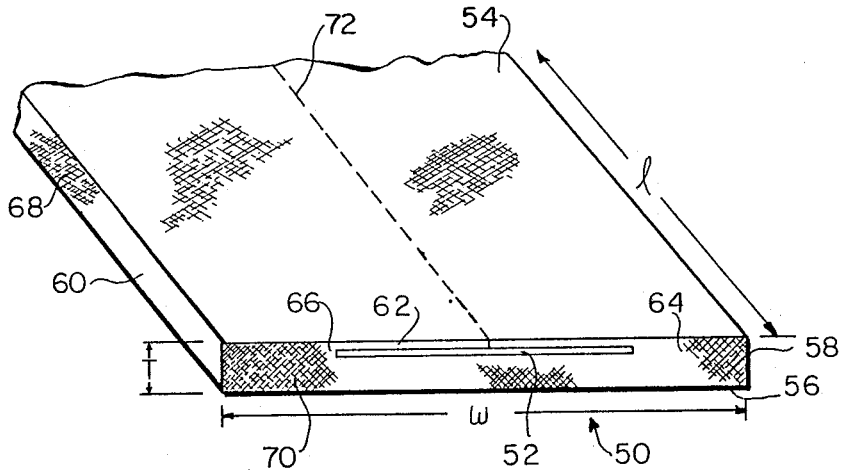
FIG. 3 is a perspective view of a slotted, multilayer woven fabric in accordance with the invention.

FIG. 3 shows a slotted, multi-layer woven fabric 50 having a slot 52 within the thickness thereof, which slot 52 extends along the length "l" of the fabric 50. The fabric 50 has a thickness "t" between opposite broad surfaces 54 and 56 thereof and a width "w" between opposite side surfaces 58 and 60 thereof. The width "w" of the fabric 50 has an intermediate portion 62 thereof along which the slot 52 extends. The width "w" also has opposite end portions 64 and 66 extending between opposite ends of the slot 52 and the opposite side surfaces 58 and 60.

Figure 5:
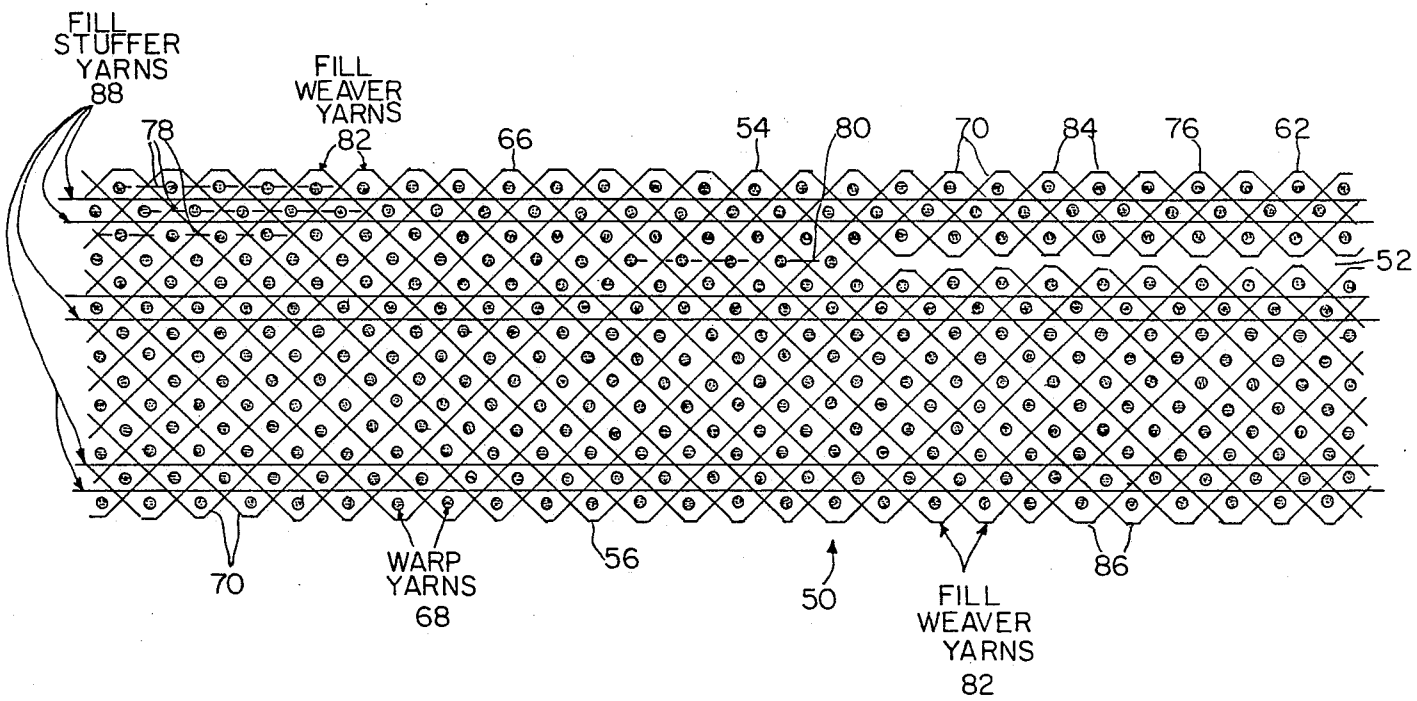
FIG. 5 is a schematic view in sectional side elevation of a portion of the fabric of FIG. 3.

As described hereafter in connection with FIG. 5, the fabric 50 is comprised of a plurality of warp yarns 68 which extend along the length "l" of the fabric in essentially the same manner that the warp yarns 12 extend along the length "l" of the fabric 10 of FIG. 1. The fabric 50 also includes fill yarns 70 which extend across the width "w" in zig-zag fashion and which are interwoven with the warp yarns 68. Unlike the fabric 10 of FIG. 1 in which the fill yarns 24 repeatedly extend through the entire thickness "t" of the fabric, the fill yarns 70 do not extend through the entire thickness "t" of the fabric 50 along the intermediate portion 62. Instead, the fill yarns 70 divide into two groups which are disposed on opposite sides of the slot 52 along the intermediate portion 62. A first such group of the fill yarns 70 extends between the broad surface 54 and the slot 52, while a second group of the fill yarns 70 extends between the opposite broad surface 56 and the slot 52. The fill yarns 70 extend through the entire thickness "t" of the fabric 50 along the opposite end portions 64 and 66.

Figure 4:
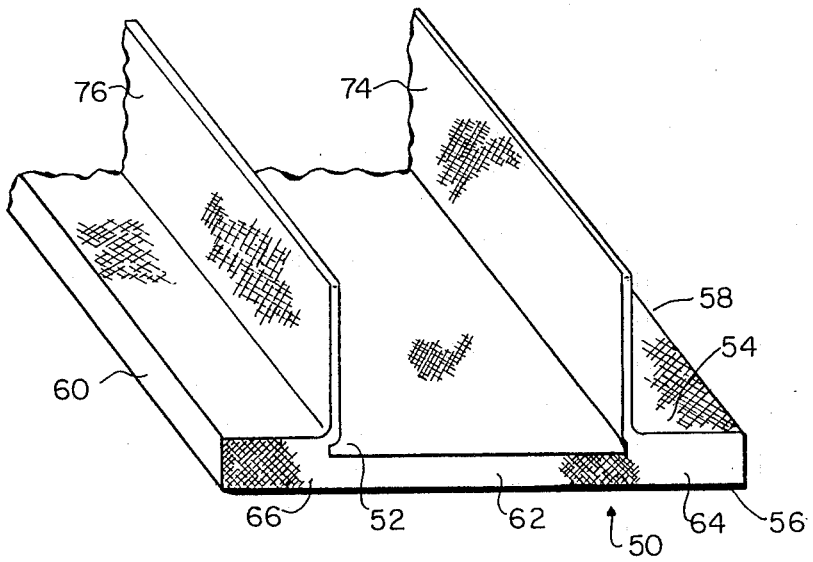
FIG. 4 is a perspective view of the fabric of FIG. 3 after the fabric has been cut along the length thereof on one side of the slot to form an opposite pair of flaps which can be used to enhance the stiffness of a structure formed by the fabric.

FIG. 4 illustrates the manner in which the slotted, multi-layer woven fabric 50 of FIG. 3 can be advantageously used. After weaving of the fabric 50, the fabric 50 is cut along the length "l" thereof between the upper broad surface 54 and the slot 52. A dotted line 72 shown in FIG. 3 indicates where the fabric 50 is cut. Cutting the fabric 50 along the dotted line 72 divides the portion of the fabric 50 between the upper broad surface 54 and the slot 52 into an opposite pair of flaps 74 and 76 shown in FIG. 4. Because the fabric 50 is flexible, the flaps 74 and 76 which extend along the entire length "l" of the fabric 50 and which are shown in FIG. 4 as being generally parallel to one another can be bent to virtually any orientation desired relative to the remainder of the fabric 50. When bent to an angle of approximately 90° relative to the remainder of the fabric 50 as shown in FIG. 4 and then stiffened, the flaps 74 and 76 are particularly useful in preventing flexure of the fabric 50 along the length hereof.

The sectional side elevation of FIG. 5 comprises the left hand position of the thickness of the fabric 50 of FIG. 3 including a left hand portion of the intermediate portion 62 and the end portion 66. The right hand portion of the thickness of the fabric 50 is of like configuration and is omitted from FIG. 5 for simplicity of illustration.

As shown in FIG. 5 the warp yarns 68 of the fabric 50 are arranged into a plurality of generally planar warp sheets 78 disposed in spaced-apart, generally parallel relation between the opposite broad surfaces 54 and 56. Several of the warp sheets 78 are represented by dotted lines in FIG. 5. The warp yarns 68 extend along the length "l" of the fabric 50. One of the warp sheets 78 comprises a warp sheet 80 which is the fourth warp sheet down from the upper broad surface 54. As shown in FIG. 5 the warp sheet 80 is unlike the other warp sheets 78 in that it extends only through the end portion 66. The warp sheet 80 terminates at the end of the slot 52, and the interface between those portions of the warp sheets 78 adjacent and on opposite sides of the warp sheet 80 which are disposed on opposite sides of the slot 52 defines the slot 52.

As shown in FIG. 5 the fill yarns 70 principally comprise fill weaver yarns 82. The fill weaver yarns 82 extend in zig-zag fashion between the opposite broad surfaces 54 and 56 across the width "w" of the fabric 50. The fill weaver yarns 82 extend through the entire thickness of the fabric 50 within the end portion 66 and within the opposite end portion 64. Along the slot 52 however, the fill weaver yarns 82 are divided into a first group 84 thereof and a second group 86 thereof. The first group 84 of the fill weaver yarns 82 repeatedly extends between the upper broad surface 54 and the slot 52 along the intermediate portion 62 of the fabric 50. The second group 86 of the fill weaver yarns 82 repeatedly extends between the opposite lower broad surface 56 and the slot 52 along the intermediate portion 62 of the fabric 50. Because the fill weaver yarns 82 do not cross the interface between the adjacent warp sheets 78 on opposite sides of the slot 52, the slot 52 is maintained.

As shown in FIG. 5 some of the fill yarns 70 comprise fill stuffer yarns 88. The fill stuffer yarns 88 extend along the width "w" of the fabric 50 in relatively straight fashion and are disposed between adjacent pairs of the warp sheets 80.

As in the case of the fabric 10 of FIG. 1, the slotted, multi-layer woven fabric 50 of FIGS. 3–5 may be woven using conventional weaving apparatus such as the Jacquard loom 40 of FIG. 2. The warp yarns 68 are disposed so as to extend through the central weaving area 42 of the loom 40 in a configuration which generally defines the relatively flat, generally planar shape of the fabric 50 between the opposite broad surfaces 54 and 56 and the opposite side surfaces 58 and 60. Each of the warp yarns 68 passes through and is controlled by the heddle attached to a different one of the harness lines 46. As the shuttle 44 traverses the central weaving area 42 to lay in the fill yarn 70 which is dispensed therefrom, the warp yarns 68 are individually raised and lowered by the associated harness lines 46 to dispose the warp yarns 68 either above or below the shuttle 44. The Jacquard machine of the loom 40 is programmed in a manner similar to that used to weave the fabric 10 of FIG. 1 during the weaving of the end portions 64 and 66 of the fabric 50. During the weaving of the intermediate portion 62 however, the program is effective in holding all of the warp yarns 68 within the top three warp sheets 80 above the second group 86 of the fill weaver yarns 82. Conversely, all of the warp yarns 68 within the bottom ten warp sheets 78 which are below the slot 52 are held beneath the first group 84 of the fill weaver yarns 82. Within the first and second groups 84 and 86 of the fill weaver yarns 82, the warp yarns 68 in the adjacent portions of the warp sheets 78 are individually controlled by the harness lines 46 to produce the zig-zag weaving configuration shown, on opposite sides of the slot 52.

Again, while any conventional loom apparatus such as a conventional shuttle loom can be used to weave a slotted fabric in accordance with the invention such as the slotted fabric 50 of FIGS. 3–5, a loom equipped with a Jacquard machine is preferred because of the large number of harness lines typically provided. In the case of the fabric 50, for example, there are 1980 warp yarns for each repeat, requiring 1980 harness lines. On the other hand, only 21 picks of the shuttle 44 are required to lay in the fill yarns 70 during each repeat of the pattern.

While there have been described above and illustrated in the drawings a number of variations, modifications and alternative forms, it will be appreciated that the scope of the invention defined by the appended claims includes all forms comprehended thereby.

What is claimed is:

1. A woven fabric having a thickness between opposite broad surfaces and comprising a plurality of warp yarns extending generally in a common direction and arranged into a plurality of warp yarn layers between the opposite broad surfaces of the fabric and a plurality of fill yarns extending through the thickness of the fabric from one of the opposite board surfaces to the other of the opposite broad surfaces and being interwoven with the plurality of warp yarns, the fill yarns being arranged into generally planar fill yarn sheets which extend through the thickness of the fabric and form acute angles with the plurality of warp yarn layers and with the opposite broad surfaces.

2. The invention as set forth in claim 1, wherein the fabric has a length and an opposite width in directions generally perpendicular to each other and to a direction of the thickness, the warp yarns are relatively straight and extend in the common direction which is along the length of the fabric and the fill yarns generally undulate over and under different ones of the warp yarns across the width of the fabric.

3. The invention as set forth in claim 1, wherein the warp yarns lie within a plurality of generally parallel, spaced-apart, generally planar warp sheets disposed between the opposite broad surfaces.

4. The invention set forth in claim 3, further including a plurality of stuffer yarns, the stuffer yarns extending in a common direction generally perpendicular to the common direction of the warp yarns, and each being disposed between an adjacent pair of the warp yarn sheets.

5. A woven fabric having a thickness between opposite broad surfaces and comprising a plurality of warp yarns extending generally in a common direction and arranged into a plurality of warp yarn layers between the opposite broad surfaces of the fabric and a plurality of fill yarns extending through the thickness of the fabric from one of the opposite broad surfaces to the other of the opposite broad surfaces and being interwoven with the plurality of warp yarns, the fill yarns terminating at an interface between an adjacent pair of the warp yarn layers across a portion of the width of the fabric to form a slot within the fabric.

6. A woven fabric having a thickness between opposite broad surfaces and comprising a plurality of warp yarns extending generally in a common direction and arranged into a plurality of warp yarn layers between the opposite broad surfaces of the fabric and a plurality of fill yarns extending through the thickness of the fabric between the opposite broad surfaces of the fabric and a plurality of fill yarns extending through the thickness of the fabric between the opposite broad surfaces and being interwoven with the plurality of warp yarns, said fill yarns terminating at an interface between an adjacent pair of the warp yarn layers across a portion of the width of the fabric to form a slot within the fabric, the fill yarns repeatedly extending through the entire thickness of the fabric between the opposite broad surfaces across a second portion of the width of the fabric, the fill yarns further being divided into first and second groups across the first-mentioned portion of the width of the fabric, the first group of fill yarns repeatedly extending through a portion of the thickness of the fabric between the slot and a first one of the opposite broad surfaces and the second group of fill yarns repeatedly extending through a different portion of the thickness of the fabric between the slot and a second one of the opposite board surfaces.

7. A woven fabric having a thickness between opposite surfaces and including a first yarn system comprising a plurality of yarns extending generally in a common direction and arranged into a plurality of first yarn system layers between the opposite broad surfaces of the fabric and a second yarn system comprising a plurality of yarns repeatedly extending through a plurality of the first yarn system layers and being interwoven with the plurality of yarns of the first yarn system, the plurality of yarns of the second yarn system repeatedly extending through the entire thickness of the fabric between the opposite broad surfaces across a first portion of the width of the fabric and repeatedly extending through opposite portions of the thickness of the fabric between the opposite broad surfaces and an interface between an adjacent pair of the first yarn system layers across a second portion of the width of the fabric to define a slot at the interface between the adjacent pair of the first yarn system layers across the second portion of the width of the fabric.

8. The invention set forth in claim 7, wherein the first yarn system consists of warp yarns and the second yarn system consists of fill yarns.

9. The invention set forth in claim 8, further including first and second pluralities of fill stuffer yarns on opposite sides of the slot, said first and second pluralities of fill stuffer yarns extending across the width of the fabric generally in a common direction perpendicular to the common direction of the plurality of yarns of the first yarn system.

10. A method of weaving a fabric having opposite broad surfaces having lengths defining a length of the fabric and widths defining a width of the fabric and being spaced apart by a distance defining a thickness of the fabric, comprising the steps of:

arranging a plurality of warp yarns into a plurality of generally planar warp sheets, the warp sheets being disposed in generally parallel, spaced-apart relation through the thickness of the fabric to be woven from one of the opposite broad surfaces to the other of the opposite broad surfaces of the fabric to be woven, and each of the warp sheets extending along the length and across the width of the fabric to be woven;

repeatedly dispensing a fill yarn in opposite directions across the width and through the thickness of the fabric from one of the opposite broad surfaces to the other of the opposite broad surfaces of the fabric to be formed;

with each dispensing of the fill yarn across the width of the fabric to be formed positioning the warp yarns within each warp sheet individually so that they are either above or below the fill yarn as the fill yarn is dispensed across the width of the fabric to be formed so that he fill yarns are interwoven with the warp yarns;

during at least some of the dispensing of the fill yarn across the width of the fabric to be formed, within each warp sheet positioning at least one of the warp yarns thereof above the fill yarn and positioning at least one of the warp yarns thereof below the fill yarn as the fill yarn is dispensed across the width of the fabric to form fill weaver yarns within the fabric to be formed; and during at least some of the dispensing of the fill yarn across the width of the fabric to be formed positioning all of the warp yarns within a first group of the plurality of warp sheets above the fill yarn and positioning all of the warp yarns of a second group of the plurality of warp sheets below the fill yarn as the fill yarn is dispensed across the width of the fabric to form fill stuffer yarns within the fabric to be formed.

11. A method of weaving a fabric having opposite broad surfaces having lengths defining a length of the fabric and widths defining a width of the fabric and being spaced apart by a distance defining a thickness of the fabric, comprising the steps of:

arranging a plurality of warp yarns into a plurality of generally planar warp sheets, the warp sheets being disposed in generally parallel, spaced-apart relation through the thickness of the fabric to be woven from one of the opposite broad surfaces to the other of the opposite broad surfaces of the fabric to be woven, and each of the warp sheets extending along the length and across the width of the fabric to be woven;

repeatedly dispensing a fill yarn in opposite directions across the width and through the thickness of the fabric from one of the opposite broad surfaces to the other of the opposite broad surfaces of the fabric to be formed;

with each dispensing of the fill yarn across the width of the fabric to be formed positioning the warp yarns within each warp sheet individually so that they are either above or below the fill yarn as the fill yarn is dispensed across the width of the fabric to be formed so that he fill yarns are interwoven with the warp yarns;

during at least some of the dispensing of the fill yarn across the width of the fabric to be formed, within each warp sheet positioning at least one of the warp yarns thereof above the fill yarn and positioning at least one of the warp yarns thereof below the fill yarn as the fill yarn is dispensed across the width of the fabric to form fill weaver yarns within the fabric to be formed;

dispensing and confining at least some of the warp yarns in a first group of the plurality of warp sheets to a first region within a predetermined number of warp sheets above the fill yarn;

dispensing and confining at least some of the warp yarns in a second group of the plurality of warp sheets to a second region within a predetermined number of warp sheets below the fill yarn; and dispensing the warp yarns along spaced apart end portions of the width of the fabric to be formed within the fill yarns, forming thereby a slot in the thickness and along the length of the fabric to be formed, the slot defined by space between the first and second regions and the spaced apart end portions.

12. A method of weaving a fabric using a loom having a plurality of harness lines extending downwardly into a weaving area and a shuttle which repeatedly traverses the weaving area, comprising the steps of:

positioning a plurality of warp yarns so as to extend along the length of a relatively thin, generally planar fabric to be formed between opposite broad surfaces of the fabric t be formed, the warp yarns extending through the weaving area and each being coupled to a different one of the plurality of harness lines;

using the shuttle to repeatedly dispense a fill yarn through the weaving area;

simultaneously, with the repeated dispensing of the fill yarn through the weaving area, individually positioning the warp yarns using the harness lines so that with each dispensing of the fill yarn through the weaving area the fill yarn is caused to repeatedly extend through the fabric to be formed from one of the opposite broad surfaces to the other of the opposite broad surfaces of the fabric to be formed; and periodically positioning the warp yarns during dispensing of the fill yarn through the weaving area so that the fill yarn extends across the fabric to be formed generally parallel to the opposite broad surfaces of the fabric to be formed and forms a fill stuffer yarn.

13. A method of weaving a fabric using a loom having a plurality of harness lines extending downwardly into a weaving area and a shuttle which repeatedly traverses the weaving area, comprising the steps of:

positioning a plurality of warp yarns so as to extend along the length of a relatively thin, generally planar fabric to be formed between opposite broad surfaces of the fabric t be formed, the warp yarns extending through the weaving area and each being coupled to a different one of the plurality of harness lines;

using the shuttle to repeatedly dispense a fill yarn through the weaving area;

simultaneously, with the repeated dispensing of the fill yarn through the weaving area, individually positioning the warp yarns using the harness lines so that with each dispensing of the fill yarn through the weaving area the fill yarn is caused to repeatedly extend through the fabric to be formed from one of the opposite broad surfaces to the other of the opposite broad surfaces of the fabric to be formed;

the warp yarns being arranged into a plurality of generally planar, spaced-apart generally parallel, warp sheets disposed between the opposite broad surfaces of the fabric to be formed;

with each dispensing of the fill yarn through the weaving area the harness lines being controlled to position some of the warp yarns in each warp sheet above and the remaining ones of the warp yarns in the warp sheet below the shuttle as the fill yarn is dispensed through the weaving area; and with selected ones of the dispensing of the fill yarn through the weaving area, controlling the harness lines to position at least one of the warp sheets above and the remaining ones of the warp sheets below the shuttle as the fill yarn is dispensed through the weaving area, to form a fill stuffer yarn.

14. A method of weaving a slotted fabric having a pair of opposite broad surfaces extending along a length of the fabric and across a width of the fabric, comprising the steps of:

extending a plurality of yarns comprising a first yarn system generally in a common direction along the length and arranged into a plurality of first yarn system layers between the opposite broad surfaces of the fabric;

repeatedly extending a plurality of yarns defining a second yarn system through a plurality of the first yarn system layers such that the yarns of the second yarn system are interwoven with the plurality of yarns of the first yarn system;

repeatedly extending the plurality of yarns of the second yarn system through the entire thickness of the fabric between the opposite broad surfaces across a first portion of the width of the fabric; and repeatedly extending the plurality of yarns of the second yarn system through opposite portions of the thickness of the fabric between the opposite broad surfaces and an interface between an adjacent pair of the first yarn system layers across a second portion of the width of the fabric for forming a slot at the interface between the adjacent pair of the first yarn system layers across the second portion of the width of the fabric.

15. The method set forth in claim 14, wherein the step of extending a plurality of yarns comprising the first yarn system comprises the step of extending a plurality of warp yarns, and the step of extending a plurality of yarns comprising the second yarn system comprises the step of extending a plurality of fill yarns.

16. The method set forth in claim 15, further comprising the steps of:

positioning first and second pluralities of fill stuffer yarns on opposite sides of the slot; and extending said first and second pluralities of fill stuffer yarns across the width of the fabric generally in a common direction perpendicular to the common direction of the plurality of yarns of the first yarn system.

17. A method of weaving a fabric having opposite broad surfaces having lengths defining a length of the fabric and widths defining a width of the fabric and being spaced apart by a distance defining a thickness of the fabric, comprising the steps of:

arranging a plurality of warp yarns into a plurality of generally planar warp sheets, the warp sheets being disposed in generally parallel, spaced-apart relation through the thickness of the fabric to be woven from one of the opposite broad surfaces to the other of the opposite broad surfaces of the fabric to be woven, and each of the warp sheets extending along the length and across the width of the fabric to be woven;

repeatedly dispensing a fill yarn in opposite directions across the width and through the thickness of the fabric from one of the opposite broad surfaces to the other of the opposite broad surfaces of the fabric to be formed;

with each dispensing of the fill yarn across the width of the fabric to be formed positioning the warp yarns within each warp sheet individually so that they are either above or below the fill yarn as the fill yarn is dispensed across the width of the fabric to be formed so that he fill yarns are interwoven with the warp yarns;

during at least some of the dispensing of the fill yarn across the width of the fabric to be formed, within each warp sheet positioning at least one of the warp yarns thereof above the fill yarn and positioning at least one of the warp yarns thereof below the fill yarn as the fill yarn is dispensed across the width of the fabric to form fill weaver yarns within the fabric to be formed; and during the at least some of the dispensing of the fill yarn across the width of the fabric to be formed positioning the warp yarns in a first group of the plurality of warp sheets above the fill yarn and positioning the warp yarns in a second group of the plurality of warp sheets below the fill yarn along a portion of the width of the fabric to be formed as the fill yarn is dispensed across the width of the fabric to be formed to form a slot in the thickness of the fabric to be formed along the portion of the width of the fabric to be formed between the first group of the plurality of warp sheets and the second group of the plurality of warp sheets.

18. A method of weaving a fabric using a loom having a plurality of harness lines extending downwardly into a weaving area and a shuttle which repeatedly traverses the weaving area, comprising the steps of:

positioning a plurality of warp yarns so as to extend along the length of a relatively thin, generally planar fabric to be formed between opposite broad surfaces of the fabric t be formed, the warp yarns extending through the weaving area and each being coupled to a different one of the plurality of harness lines;

using the shuttle to repeatedly dispense a fill yarn through the weaving area;

simultaneously, with the repeated dispensing of the fill yarn through the weaving area, individually positioning the warp yarns using the harness lines so that with each dispensing of the fill yarn through the weaving area the fill yarn is caused to repeatedly extend through the fabric to be formed from one of the opposite broad surfaces to the other of the opposite broad surfaces of the fabric to be formed;

the fabric to be formed having a width across the weaving area through which the shuttle is repeatdly dispensed, and the warp yarns being individually positioned using the harness lines with each dispensing of the fill yarn through the weaving area so that the fill yarn is caused to repeatedly extend through either one of the other of opposite portions of the thickness of the fabric between the opposite board surfaces of the fabric to be formed along a portion of the width of the fabric to be formed, so that the fabric to be formed will be formed with a slot therein between the opposite portions of the thickness along said portion of the width, the warp yarns within the one of the opposite portions of the thickness of the fabric all being positioned above the fill yarn when the fill yarn is caused to repeatedly extend through the other of the opposite portions of the thickness of the fabric, and the warp yarns within the other of the opposite portions of the thickness of the fabric all being positioned below the fill yarn when the fill yarn is caused to repeatedly extend through the one of the opposite portions of the thickness of the fabric.

19. A method of weaving a slotted fabric comprising the steps of:

positioning a plurality of warp yarns in a relatively thin, generally planar array defining the shape of a slotted fabric to be formed, the warp yarns extending in a common direction along the length of the slotted fabric to be formed and being disposed across the width of the slotted fabric to be formed between opposite broad surfaces of the slotted fabric to be formed, the slotted fabric to be formed having a thickness between the opposite broad surfaces, and the width of the fabric being divided into a slotted central portion between opposite end portions; and repeatedly dispensing a fill yarn across the width of the slotted fabric to be formed so that the fill yarn repeatedly extends through the thickness of the slotted fabric to be formed along the opposite end portions of the width and repeatedly extends through one or the other of opposite portions of the thickness along the slotted central portion of the width, all of the warp yarns within the one of the opposite portions of the thickness being positioned above the fill yarn as the fill yarn is repeatedly entended through the other of the opposite portions, and all of the warp yarns within the other of the opposite portions of the thickness being positioned below the fill yarn as the fill yarn is repeatedly entended through the one of the opposite portions.

20. The invention as set forth in claim 18, comprising the further step of repeatedly dispensing a fill yarn across the width of the slotted fabric to be formed so that the fill yarn is disposed between and generally parallel to the opposite broad surfaces of the fabric to be formed, to form fill stuffer yarns therein.

* * * * *